United States Patent [19]

Etuya et al.

[11] Patent Number: 4,932,200

[45] Date of Patent: Jun. 12, 1990

[54] ROTARY RING FOR SPINNING MACHINERY

[75] Inventors: Kunio Etuya; Naofumi Kobayashi, both of Amagasaki; Takeshi Yoshikawa, Sanda; Noboru Ishibashi, Amagasaki, all of Japan

[73] Assignee: Kanai Juyo Kogyo Company Limited, Hyogo, Japan

[21] Appl. No.: 376,025

[22] Filed: Jul. 6, 1989

[30] Foreign Application Priority Data

Jul. 12, 1988 [JP] Japan ..... 63-173459

[51] Int. Cl.[5] ..... D01H 7/56; D01H 7/58

[52] U.S. Cl. ..... 57/124; 57/122

[58] Field of Search ..... 57/122, 123, 124, 119, 57/120, 101-104

[56] References Cited

U.S. PATENT DOCUMENTS

| | | | |
|---|---|---|---|
| 3,324,643 | 6/1967 | Kluttz | 57/124 |
| 3,481,131 | 12/1969 | Chilpan | 57/124 |
| 3,494,120 | 2/1970 | Chilpan et al. | 57/122 X |
| 3,611,697 | 10/1971 | Greb | 57/124 |
| 4,030,282 | 6/1977 | Spies | 57/124 |
| 4,244,170 | 1/1981 | Traynard et al. | 57/124 |
| 4,270,340 | 6/1981 | Baucom et al. | 57/122 X |
| 4,596,114 | 6/1986 | Donnelly | 57/101 X |

FOREIGN PATENT DOCUMENTS

| | | |
|---|---|---|
| 48-77130 | 10/1973 | Japan . |
| 60-56807 | 12/1985 | Japan . |

*Primary Examiner*—John Petrakes

*Attorney, Agent, or Firm*—Wenderoth, Lind & Ponack

[57] ABSTRACT

Disclosed is a rotary ring for spinning machinery, such as ring spinning machines and ring twisting macines, which provides stabilized rotation of a ring-shaped rotator and involves no end breakage of yarn during spinning. This is accomplished by specifying the coefficient of friction $\mu$ between the ring-shaped rotator and the ring-shaped supporter, the relation between the weight W of the ring-shaped rotator and the outside diameter $D_1$ and ring-shaped top flange inside diameter $D_2$, and the relation between the width A along the radial direction and the height H along the axial directio between the sliding surfaces of the ring-shaped rotator and the ring-shaped supporter. This rotary ring makes it possible to realize higher spindle speed and higher productivity of yarn.

7 Claims, 5 Drawing Sheets

ROTARY RING FOR SPINNING MACHINERY

BACKGROUND OF THE INVENTION

1. Field of the Invention:

This invention relates to a rotary ring for spinning machinery, such as ring spinning machines, ring twisting machines, etc., particularly, a rotary ring for spinning machinery of such type that its ring-shaped rotator is turned by frictional resistance with a traveller.

2. Description of Prior Art:

As to rotary rings of this kind, there have been suggested, for example, a rotary ring of such type that a ring-shaped rotator is caused to lift by air pressure so as to realize a higher spindle speed of spinning machinery and to improve productivity and a rotary ring of such type that a ring is supported by bearings at its circumference. Additionally, FIG. 8 shows a rotary ring of a type wherein a sliding body (15) is interposed between a ring-shaped rotator (13) and a ring-shaped holder (14) and the ring-shaped rotator (13) is supported rotatably. This arrangement is set forth in Japanese Patent Application Publication Gazette No. 60-56807.

This rotary ring comprises a ring-shaped rotator having a ring-shaped flange at a top part thereof, a sliding wheel and a holder. The height of the sliding surface of a sliding part is made $\frac{1}{3}$–$\frac{3}{4}$ of the total height of a rotary ring so as to make rotation during spinning smooth and to reduce partial lifting.

Another rotary ring type is set forth in Japanese Laid Open Patent Application Gazette No. 48-77130. This rotary ring limits the weight (W) of its rotary ring to within the scope obtained by the following formula as a function of the ring diameter (inside diameter of ring-shaped flange):

$$0.01050-0.40+70 \geqq W \geqq 0.01050-0.40+50$$

(W is the weight (in grams) of the rotary ring and 0 is the diameter (in millimeters of the ring).

This rotary ring, even if the spindle is turned at a speed higher than usual, involves the least frictional resistance between the rotary ring and a seating ring which supports the rotary ring. Thus, the rotary ring turns effectively and smoothly, free from vibration.

However, rotary rings of these types in which a ring rotator turns by frictional force with a traveller raise the following problem.

In the case of the rotary ring shown in FIG. 8, if the sliding area between the ring-shaped rotation (13) and the sliding body (15) normal to the thrust (or axial direction is to much larger than the sliding area between the ring-shaped rotation (13) and the sliding body (15) radial direction, the frictional torque increases and rotation of the ring-shaped rotator is impeded and contact pressure increases. On the other hand, if the sliding area normal to the thrust direction is too much smaller than the sliding area normal to the radial direction, the sliding surface normal to the thrust direction is subject to greater wear. Also, if the weight of the ring-shaped rotator is too large, frictional force between the ring-shaped rotator and the sliding body becomes large, with the result that the number of revolutions required for the ring-shaped rotator cannot be obtained and fluffing occurs frequently. On the other hand, if the weight of the ring-shaped rotator is too light, frictional force between the ring-shaped rotator and the sliding body becomes too small, with the result that when a spindle is stopped, the ring-shaped rotator does not stop but continues to turn by inertia and a traveller turns as it follows the revolution of the ring-shaped rotator. This can cause snarls of spinning yarn and end breakage at restarting.

For the rotary ring it is general practice to lighten the weight of a ring-shaped rotator so as to increase r.p.m. of the ring-shaped rotator. For lightening the weight of the ring-shaped rotator, thickness of a trunk part of the ring-shaped rotator is reduced or its height is reduced. However, the thickness of a trunk part of the ring-shaped rotator cannot be made too thin because the relation with the ring diameter must be taken into consideration. Also, a thin trunk part is apt to warp and therefore abnormal rotation of the ring-shaped rotator occurs. If the height of the ring-shaped rotator is reduced, fluctuation to a clearance between the ring-shaped rotator and the sliding body becomes large and setting of a proper clearance is made difficult.

An object of the present invention is to stabilize and make smooth the rotation of the ring-shaped rotator. Another object of the present invention is to provide a rotary ring which stabilizes sliding of a traveller and which is free from end breakage and abnormal wear.

SUMMARY OF THE INVENTION

A rotary ring according to the present invention carries a ring-shaped rotator with a ring-shaped flange at a top part thereof, which is supported slidably by the ring-shaped supporter. In this rotary ring, the weight W (in grams) of the ring-shaped rotator and the outside diameter $D_1$ (in millimeters) are expressed by $W/D_1=1.5$ g/mm$-3.0$ g/mm preferably $W/D_1=1.8$ g/mm$-2.8$ g/mm, and in the sliding surface of the ring-shaped rotator, the height H along the axial (in millimeters) direction and the width A (in millimeters) along the radial direction are expressed by $H/A=2.0-\chi 3.0$. Also, the weight W (in grams) of the ring-shaped rotator and the inside diameter $D_2$ (in millimeters) ring-shaped top flange are expressed by the following relative formula, $$(2\ \text{g/mm} \times D_2 - 10\ \text{g}) \leqq W \leqq (3\ \text{g/mm} \times D_2 - 10\ \text{g})$$

where $D_2$ is in the range of 30–80 mm.

A ring-shaped supporter is made of synthetic resin, such as ethylene tetrafluoride, polyethylene, polystyrene, nylon, etc., having the coefficient of friction $\mu$ of $0.05 \leqq \mu < 0.3$.

BRIEF DESCRIPTION OF THE DRAWINGS

The nature and advantage of the present invention will be understood more clearly from the following description made with reference to the accompanying drawings, in which.

DETAILED DESCRIPTION OF THE INVENTION

A rotary ring according to the present invention has a ring-shaped rotator with a ring-shaped top flange at a top part thereof, supported slidably by a ring-shaped supporter. This ring-shaped supporter is made of synthetic resin, such as ethylene tetrafluoride, polyethylene, polystyrene, nylon, etc., and the coefficient of friction $\mu$ between the ring-shaped rotator and the ring-shaped supporter is within the limits of $0.05 \leqq \mu < 0.3$.

Figure 4:
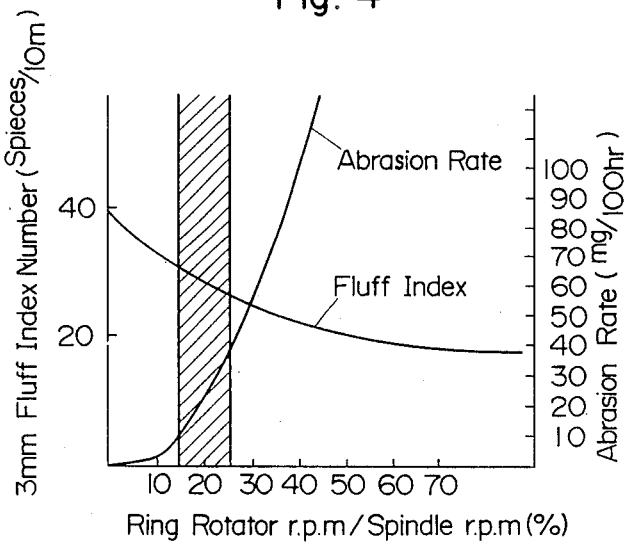
FIG. 4 is a drawing, showing the relation between the ratio of rotation (between r.p.m. of the ring-shaped rotator and r.p.m. of the spindle) and index number of fluffing/amount of wear of the ring-shaped supporter.

In the case where the weight of a ring-shaped rotator is made constant, if the coefficient of friction $\mu$ is less than 0.05, frictional force becomes small and rotation of the ring-shaped rotator increases nearly up to the spindle speed. As a result, wear of the ring-shaped supporter increases abruptly. On the other hand, if the coefficient of friction exceeds 0.3, frictional force becomes large and rotation of the ring-shaped rotator becomes too slow. As a result, fluffing occurs frequently and quality of yarn is lowered. FIG. 4 shows the relation between the ratio of rotation (between r.p.m. of the ring-shaped rotator and r.p.m. of spindle) and the fluffing of 3 mm in length/amount of wear of the ring-shaped supporter. From this figure, it has been found that in the case where the above ratio of rotation is within the limits of $$\frac{\text{r.p.m. of ring rotator}}{\text{r.p.m. of spindle}} \times 100 = 15 - 25\%,$$

it is proper for fluffing and amount of wear.

Figure 5:
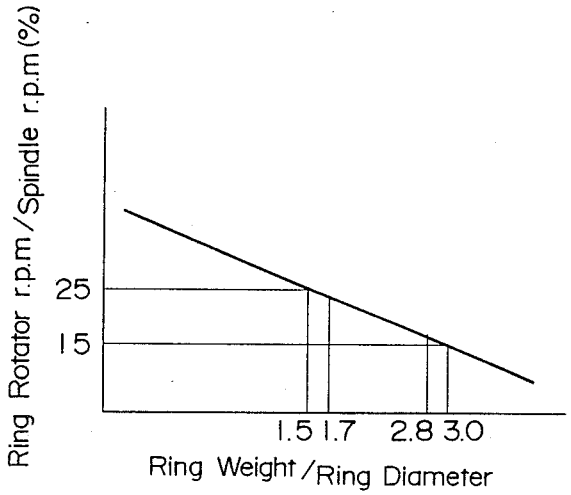
FIG. 5 is a drawing, showing the relation between the ratio of rotation (between r.p.m. of the ring-shaped rotator and r.p.m. of the spindle) and weight of ring-shaped rotator/ring diameter.
Figure 8:
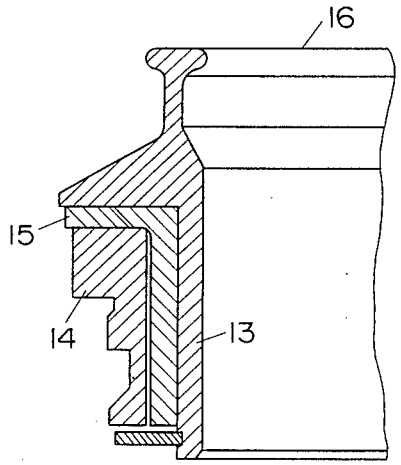
Fig. 8 PRIOR ART
FIG. 8 is a cross section, partly broken away, of a conventional rotary ring.

For obtaining the above ratio of rotation, it has been found that the ratio of the weight W (in grams) of the ring-shaped rotator to the outside diameter $D_1$ (in millimeters), is required to satisfy the relative formula of $W/D_1 = 1.5$ g/mm $-3.0$ g/mm, preferably $W/D_1 = 1.7$ g/mm $-2.8$ g/mm, as shown in FIG. 5.

Figure 6:
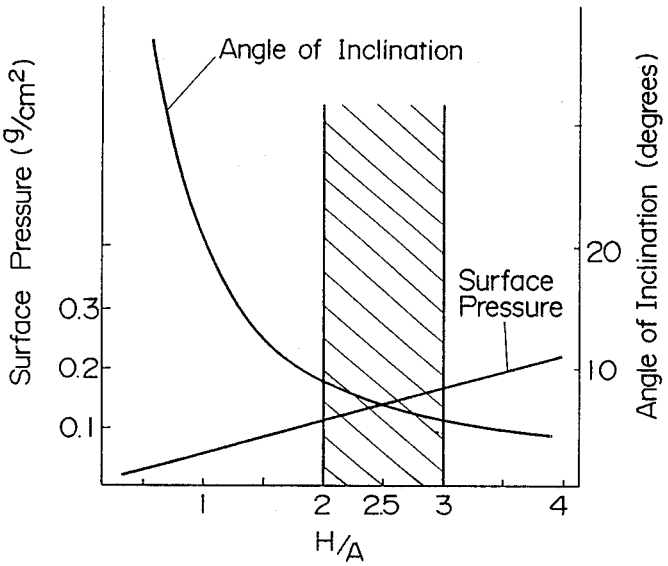
FIG. 6 is a drawing, showing the relation between the ratio (between the width of a sliding surface in thrust direction and the height of a sliding surface in radial direction) and surface pressure/inclination of the ring-shaped rotator to the ring-shaped supporter.

With regard to the surface pressure of a sliding part of the ring-shaped rotator and its inclination to the ring-shaped supporter, we have investigated experimentally into the relation between the width A (in millimeters) of the sliding surface normal to the thrust (or axial) direction and the height H (in millimeters) of the sliding surface along the axial direction and obtained the result as shown in FIG. 6. As is obvious from FIG. 6, we have found it necessary to satisfy the relative formula of $H/A = 2.0 \sim 3.0$.

In the rotary ring, a clearance C of some extent is necessary between the sliding part and the ring rotator, especially in the radial direction. Due to this clearance, conventional rotary rings were not free from partial lifting. However, in the present invention in which the above range is adopted, even if the clearance of the sliding part is large, partial lifting can be prevented and the ring-shaped rotator turns smoothly. Therefore, stabilized rotation can be obtained, wear of the ring supporter at an early stage does not occur and end breakage is reduced.

Figure 7:
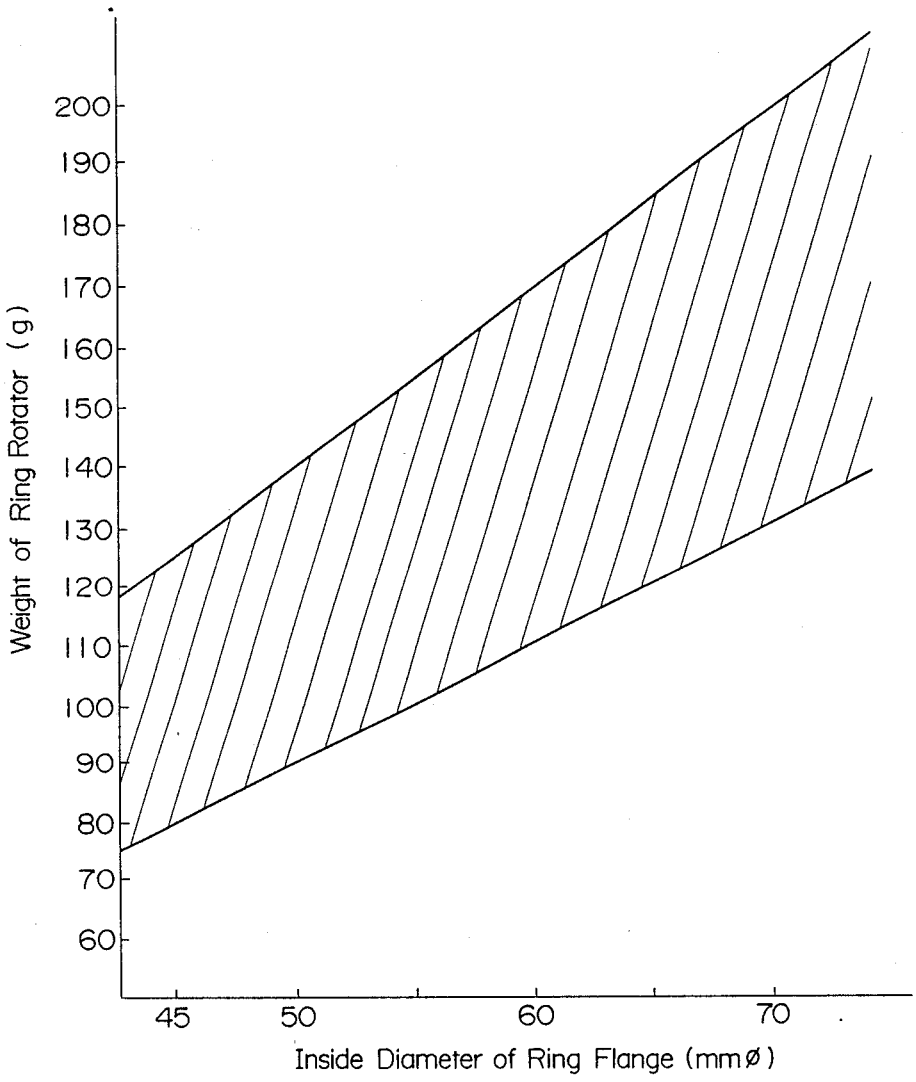
FIG. 7 is a drawing, showing the relation between the inside diameter of ring-shaped flange and the weight of ring-shaped rotator.

Regarding the rotary ring which satisfied the above two relative formulae, the relation between the weight W (in grams) of the ring-shaped rotator and the inside diameter $D_2$ (in millimeters) of ring-shaped to flange should preferably be within the limits of $$(2\ \text{g/mm} \times D_2 - 10\ \text{g}) \leqq W \leqq (3\ \text{g/mm} \times D_2 - 10\ \text{g})$$

where $D_2$ is in the range of 30—80 mm.

which is within the optimum range shown in FIG. 7.

In the case where the weight W of the ring-shaped rotator is less than $(2\ \text{g/mm} \times D_2) - 10$ g, if the coefficient of friction $\mu$ is constant, the frictional force becomes small and rotation of the ring-shaped rotator becomes large, causing early wear of the ring-shaped supporter. On the other hand, if the weight W of the ring-shaped rotator exceeds $(3\ \text{g/mm} \times D_2) - 10$ g, the frictional force becomes large and the ratio between the ring weight and the ring diameter (shown in FIG. 5) also becomes large. Thus, the ratio of rotation between r.p.m. of the ring rotator and r.p.m. of the spindle becomes, too small, which, coupled with the increase of frictional force, causes a large increase of fluffing.

If the rotation of the ring-shaped rotator becomes too large as mentioned above, when the spindle is stopped, the ring-shaped rotator does not stop but continues to turn by inertia and a traveller turns as it follows the rotation of the ring-shaped rotator. This can cause snarling of spinning yarn and end breakage.

Embodiment 1

Figure 1:
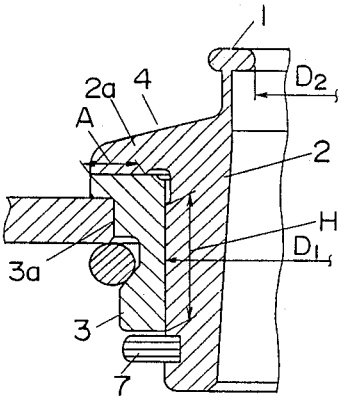
FIG. 1 is a cross section, partly broken away, of Embodiment 1.

As shown in FIG. 1, a ring-shaped rotator 2 is made of carbon steel, alloy steel or the like and has a ring flange 1 at a top part thereof. The ring-shaped rotator 2 is 76 mm in ring (outside) diameter $D_1$, 63.5 mm in ring-shaped flange inside diameter $D_2$ and 120 g in weight W. A ring-shaped sliding flange 2*a* is provided integrally at the outer circumferential part of a trunk part of the ring-shaped rotator 2. A ring-shaped supporter 3 is made of ethylene tetrafluoride resin having the coefficient of friction of $0.2\mu$ in relation to a metal member. The ring-shaped supporter 3 is annular in shape and has at its outer circumferential part a fitting part 3*a* to fit a ring rail.

A rotary ring 4 is composed in such a fashion that the ring-shaped rotator 2 is supported slidably by the ring-shaped supporter 3 with a small clearance C therebetween. The rotary ring 4 is so composed that the relation of the width A (in millimeters) of a sliding surface normal to the thrust direction between the undersurface of the sliding flange 2*a* of the ring-shaped rotator 2 and the upper surface of the ring-shaped supporter 3 to the height H (in millimeters) of a sliding a surface normal to the radial direction between the outer circumferential part of the ring-shaped rotator 2 and the inner circumferential part of the ring-shaped supporter 3 is $2A = H$.

Embodiment 2

Figure 2:
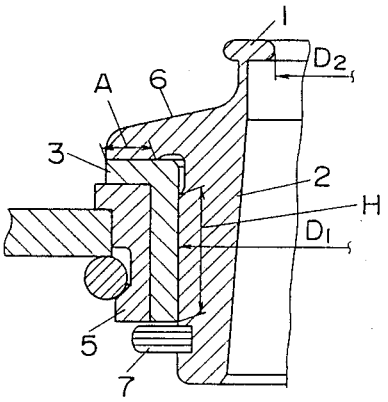
FIG. 2 is a cross section, partly broken away, of Embodiment 2.

As shown in FIG. 2, a rotary ring 6 is composed by fitting a ring-shaped fixing body 5 formed by a light weight member, such as aluminium alloy, synthetic resin or the like, in an outer circumferential part of the ring-shaped supporter 3 of the rotary ring formed similarly to Embodiment 1.

In the drawings for each embodiment, reference numeral 7 designates a retaining ring for preventing the ring-shaped rotator from slipping off the ring-shaped supporter.

Figure 3:
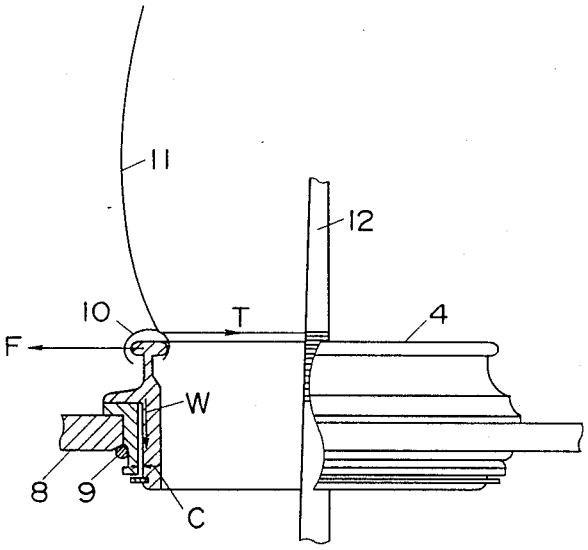
FIG. 3 is an explanatory drawing, showing how Embodiment 1 is used.

How the rotary ring of the present invention is used is explained below, with reference to FIG. 3.

The ring-shaped supporter 3 of the rotary ring-shaped 4 is fitted to a ring rail 8 and is fixed by a set spring 9. Spinning yarn 11 is caught by a traveller 10 hung on the ring-shaped top flange 1 and is wound around a bobbin 12 put on a spindle.

Under the above state, if a spindle is turned, spinning yarn 11 is wound round a bobbin as it is drawn to the bobbin. At this time, the traveller slides on the ring-shaped flange 1 by winding tension T applied to yarn 11. The ring-shaped rotator 2 turns by contact pressure between the traveller 10 and the ring-shaped flange 1. This contact pressure is generally $\frac{1}{2}-\frac{1}{3}$ of the centrifugal force F of the traveller.

The results of spinning tests by using the rotary ring of the present invention and the conventional rotary ring are shown in the following table.

TABLE 1

| | Concrete example | | | | |
|---|---|---|---|---|---|
| | Present invention | | | Comparative example | |
| Item | 1 | 2 | 3 | 1 | 2 |
| Spinning yarn | Tetoron cotton 45' S | Acryl 24 Nm | Polyester/ cotton 6' S | Acryl 24 Nm | Tetoron/ cotton 45' S |
| Ring diameter mm | 53 | 76 | 81 | 76 | 53 |
| Ring inside diameter mm | 45 | 63.5 | 70 | 63.5 | 45 |
| Number of revolution of spindle r.p.m. | 14000 | 8000 | 6850 | 8000 | 14000 |
| Traveller and its weight g | HZ/hf 5/0 0.035 | CH/WZ NO. 7 0.124 | BZ/hf NO. 15 0.283 | OH/WZ NO. 7 0.124 | ZS/hf 5/0 0.035 |
| Number of revolutions of ring-shaped rotator r.p.m. | 2800 | 2000 | 1500 | 3000 | 4800 |
| Weight of ring-shaped rotator g | 80 | 120 | 200 | 80 | 43 |
| Coefficient of friction between ring-shaped rotator and ring-shaped supporter $\mu$ | 0.2 | 0.2 | 0.2 | 0.2 | 0.2 |
| Ratio between width A and height H of sliding surface | H = 2A | H = 2A | H = 2.5A | H = A | H = 1.5A |
| Frequency of end breakage Pcs/400 SP/hr | 3 | 3 | 3 | 5 | 6 |
| Number of pieces of 3 mm fluff | 30 | 60 | 20 | 100 | 60 |

As shown above in Table 1, as compared with conventional rotary rings, the rotary ring according to the present invention involved less incidence of end breakage and fluffing and thus made it possible to spin yarn of good quality.

Since the rotary ring according to the present invention is composed as mentioned above, it provides stabilized rotation. Moreover, as the ring-shaped rotator stops almost at the same time as a spindle stops, end breakage is reduced to a large extent and yarn of good quality with less fluff can be spun.

From the foregoing advantages, use of rotary rings according to the present invention makes it possible to increase the spindle speed still more and to realize high productivity of yarn.

What is claimed is:

1. A rotary ring for use in spinning machinery, comprising:

a ring-shaped support element;

a ring-shaped rotator element rotatably mounted within said support element and forming a first contact surface between itself and said support element;

a ring-shaped sliding flange mounted to and extending radially outwardly from said rotator element such that a second contact surface is formed between said sliding flange and said support element; and wherein $W/D_1$ is in the range of 1.5 g/mm to 3.0 g/mm and H/A is in the range of 2.0 to 3.0, W being the weight of said rotator element, $D_1$ being the outside diameter of said rotator element, H being the axial length of said first contact surface and A being the radial width of said second contact surface.

2. A rotary ring as recited in claim 1, wherein $W/D_1$ is in the range of 1.7 g/mm to 2.8 g/mm.

3. A rotary ring as recited in claim 1, further comprising a ring-shaped top flange mounted to a top end of said rotator element and having an inside diameter $D_2$ in the range of 30 mm to 80 mm; and said inside diameter $D_2$ of said top flange and said weight of said rotator element are related by the equation:

$$(2\ \text{g/mm} \times D_2 - 10\ \text{g}) \leqq W \leqq (3\ \text{g/mm} \times D_2 - 10\ \text{g}).$$

4. A rotary ring as recited in claim 1, wherein said support element is formed of a synthetic resin having a coefficient of friction $\mu$ in the range of:

$$0.05 \leqq \mu \leqq 0.3.$$

5. A rotary ring as recited in claim 4, wherein said synthetic resin is at least one of ethylene tetrafluoride, polyethylene, polystyrene, and nylon.

6. A rotary ring as recited in claim 1, further comprising a ring-shaped fixing body means for supporting said supporter element.

7. A rotary ring as recited in claim 1, further comprising a retainer ring mounted about a lower end of said rotator element below said supporter element to retain said rotator element mounted within said support element.

* * * * *